US006941971B1

(12) United States Patent
Hsien

(10) Patent No.: US 6,941,971 B1
(45) Date of Patent: Sep. 13, 2005

(54) DUAL USE STAND TYPE FAUCET USED IN KITCHEN

(76) Inventor: Yu-You Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/788,076

(22) Filed: Feb. 27, 2004

(51) Int. Cl.[7] ..... E03C 1/04
(52) U.S. Cl. ..... 137/801
(58) Field of Search ..... 137/801

(56) References Cited

U.S. PATENT DOCUMENTS 6,093,313 A * 7/2000 Bovaird et al. ..... 137/801
6,179,130 B1 * 1/2001 Nguyen et al. ..... 137/801
6,220,298 B1 * 4/2001 Wu ..... 137/801

* cited by examiner

*Primary Examiner*—Gerald A. Michalsky

(57) ABSTRACT

A dual use stand type faucet used in a kitchen comprises a front sleeve tube engaged at an output end of a dual water outlet front tube. A water outlet is located at a lower side of the front sleeve tube. The front sleeve tube has a receiving channel for receiving a cleaning inner tube. One end of the receiving channel is expanded to form with an inner threaded channel. A clean water outlet penetrates through the threaded channel. A water control stud is screwed into the threaded channel. A handle is installed in front of the water control stud. A rear side of the water control stud resists against a front end of the cleaning inner tube. A middle section of the water control stud has a water outlet window. The window is arranged above a front end of the clean water outlet. Thereby, the control handle controls the supply of clean water directly.

1 Claim, 3 Drawing Sheets

DUAL USE STAND TYPE FAUCET USED IN KITCHEN

FIELD OF THE INVENTION

The present invention relates to faucets, and particular to a dual use stand type faucet used in a kitchen.

BACKGROUND OF THE INVENTION

The use of kitchen faucet is mainly used to supply clean water. For drinking or cooking water, generally, a water clean device is added to the kitchen. The device has a clean water supply tube which is located near the faucet so that the user can operate easily. However, this will make the space of the kitchen become smaller so as to interfere the operation of users.

In the prior art, the general water supplying tube and clean water supply tube are coaxial and are connected to a faucet which serves to switch the supply of general water and clean water. In this arrangement, a general water control stud and a clean water control stud are arranged with the faucet so that the arrangement of elements are complicated and yield ratio is low. Moreover, the control handles for general water and clean water at lateral sides of a faucet have difference in position arrangement. However, two handles are used so that users often make mistakes in selecting a desired handle to supply desired water.

SUMMARY OF THE INVENTION

Accordingly, the object of the present invention is to provide a dual use stand type faucet used in a kitchen. The faucet comprises a front sleeve tube engaged at an output end of the dual water outlet front tube. A water outlet is located at a lower side of the front sleeve tube. The front sleeve tube has a receiving channel for receiving the cleaning inner tube. One end of the receiving channel is expanded to form with a threaded channel which is threaded on the inner wall. A clean water outlet penetrates through the threaded channel. A water control stud is screwed into the threaded channel. A handle is installed in front of the water control stud. A rear side of the water control stud resists against a front end of the cleaning inner tube. A middle section of the water control stud has a water outlet window. The window is arranged above a front end of the clean water outlet. Thereby, the control handle controls the supply of clean water directly.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
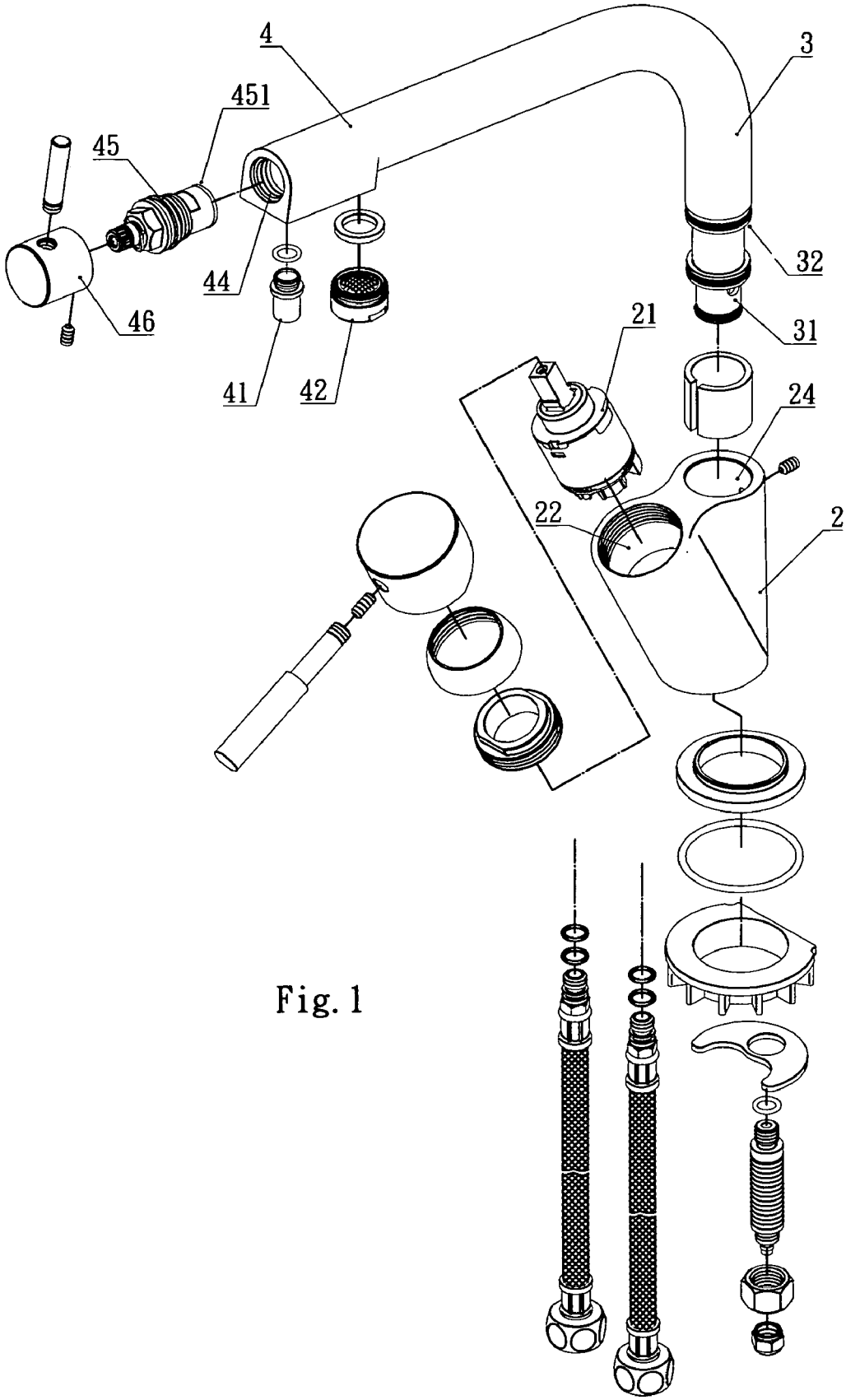
FIG. 1 is an exploded perspective view of the present invention.
Figure 2:
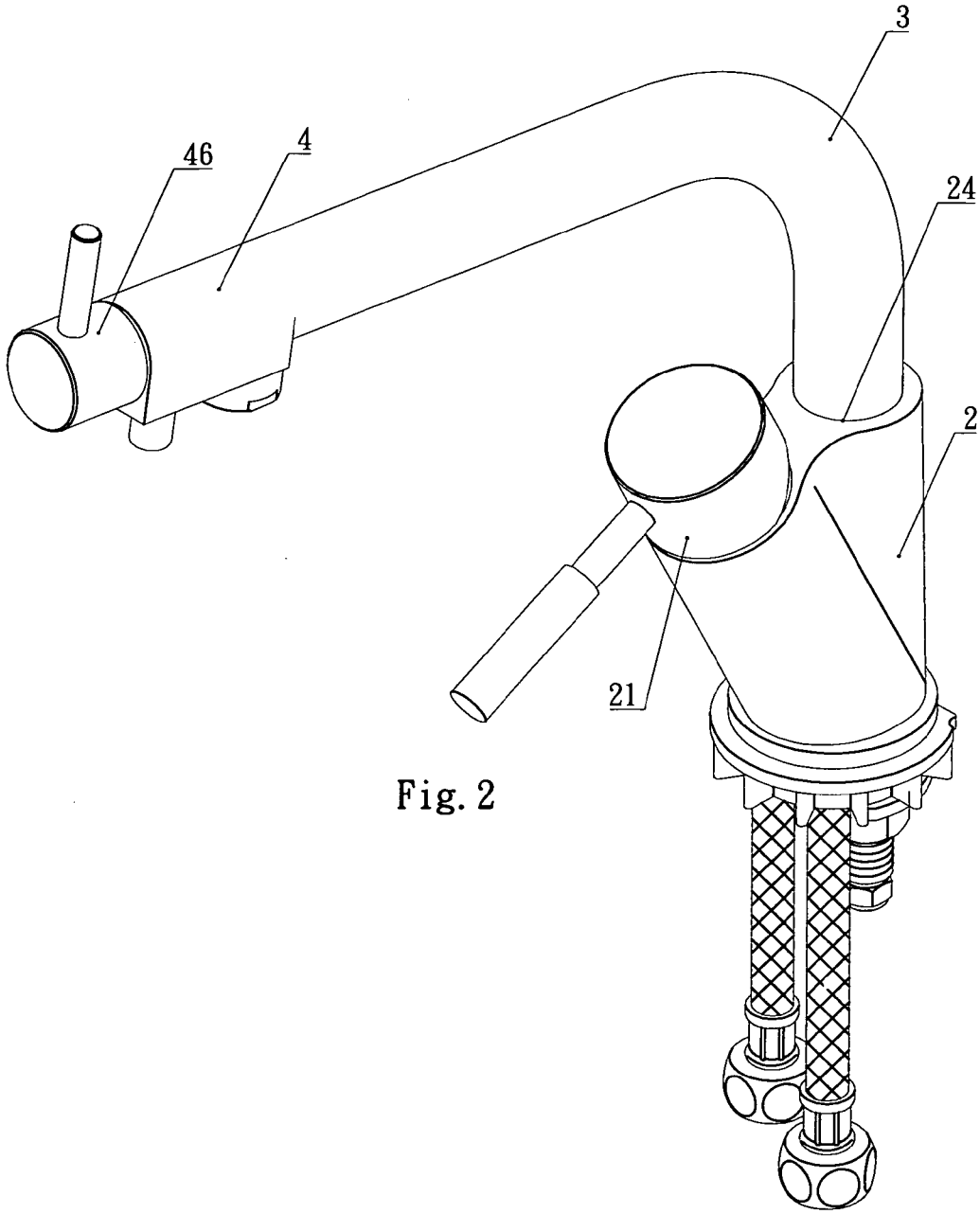
FIG. 2 is an assembled perspective view of the present invention.
Figure 3:
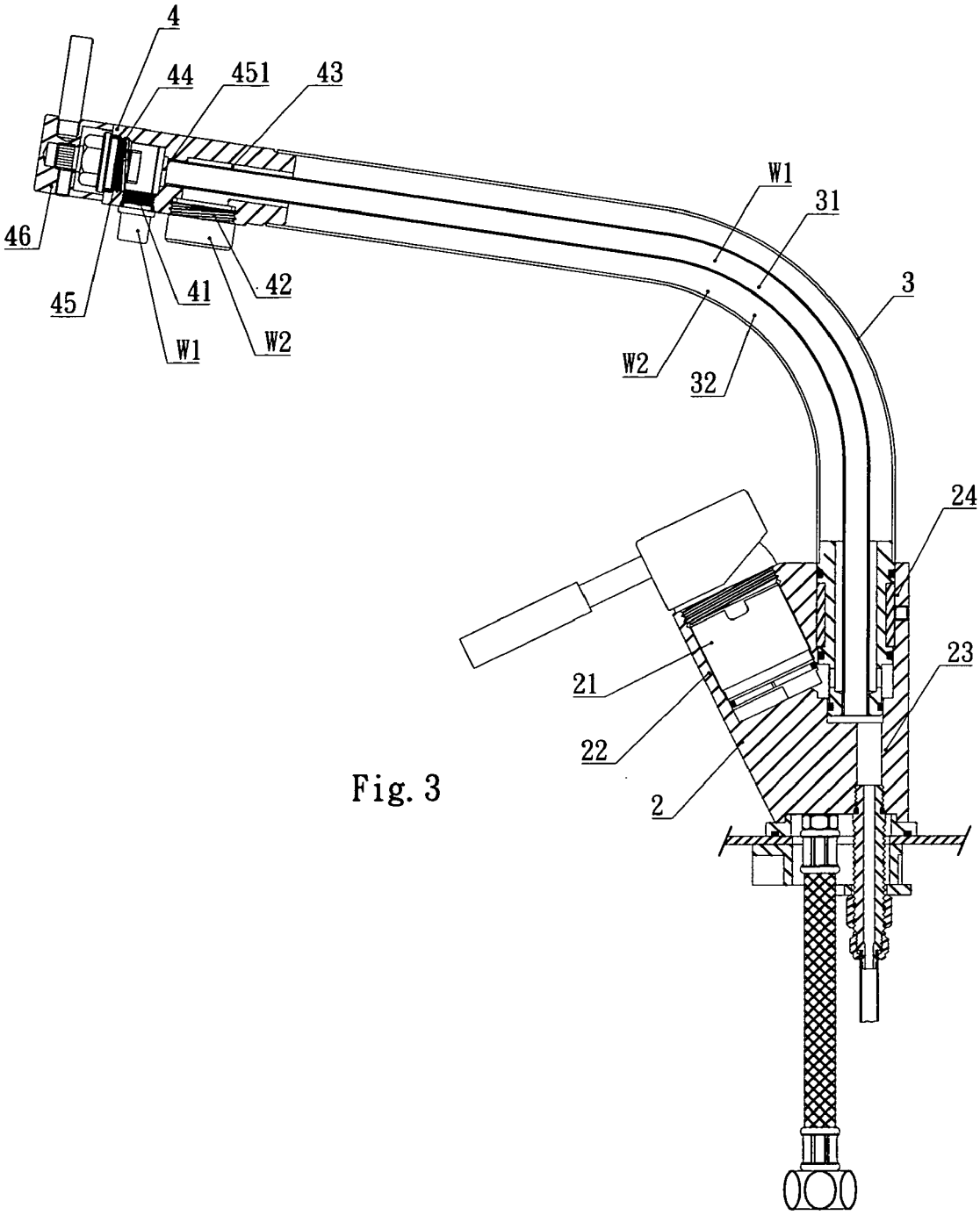
FIG. 3 is a cross section view of the present invention.

With reference to FIGS. 1 to 3, the present invention comprises the following elements.

A dual water outlet front tube 3 has an outer tube 32 and a cleaning inner tube 31 within the outer tube 32. The general water W2 flows through the space between the cleaning inner tube 31 and outer tube 32; and clean water flows in the cleaning inner tube 31.

A main body 2 includes a dual water supply tube head 24 which is connected to a cleaning inner tube 31 of the dual water outlet front tube 3. A control valve 21 serves for controlling the mixing of cold and hot water of water W2 and a supply slot 22 used of water W2.

A front sleeve tube 4 is engaged at an output end of the dual water outlet front tube 3. A water outlet 42 is at a lower side of the front sleeve tube 4. The front sleeve tube 4 has a receiving channel 43 for receiving the cleaning inner tube 31. One end of the receiving channel 43 is expanded to form with a threaded channel 44 which is threaded on the inner wall. A clean water outlet 41 penetrates through the threaded channel 44. A water control stud 45 is screwed into the threaded channel 44. A handle 46 is installed in front of the water control stud 45. A rear side of the water control stud 45 resists against a front end of the cleaning inner tube 31. A middle section of the water control stud 45 has a water outlet window 451. The window 451 is arranged above a front end of the clean water outlet 41. Thereby, the control handle 46 can control the supply of clean water directly.

By above mentioned structure, when a user desires to use general water W2, the water control stud 45 is operated to seal the water. Then the control valve 21 of general water W2 is opened. Then the mixing ratio of hot and cool water is controlled by the opening of the control valve 21. Then the general water W2 flows into the outer tube 32 of the dual water outlet front tube 3. Then the water W2 flows to the water outlet 42 of general water W2 at a lower side of the front sleeve tube 4.

When a user desires to have clean water W1, the control valve 21 of general water W2 is closed so that no water is supplied. Then the water control stud 45 of clean water W1 is opened and water flow is controlled. Thereby, clean water W1 flows into the cleaning inner tube 31 of the dual water outlet front tube 3 from the dual water supply tube head 24 to flow to the water outlet 42 of clean water W1 at a lower side of the front sleeve tube 4.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A dual use stand type faucet used in a kitchen comprising:

a dual water outlet front tube having an outer tube and a cleaning inner tube within the outer tube; wherein general water flows through a space between the cleaning inner tube and outer tube; and clean water flows in the cleaning inner tube;

a main body including a dual water supply tube head which is connected to a cleaning inner tube of the dual water outlet front tube;

a control valve for controlling the mixing of clean and general water;

a front sleeve tube engaged at an output end of the dual water outlet front tube; a water outlet being at a lower side of the front sleeve tube; the front sleeve tube having a receiving channel for receiving the cleaning inner tube; one end of the receiving channel being expanded to form with a threaded channel which is threaded on an inner wall thereof; a clean water outlet penetrating through the threaded channel; a water control stud being screwed into the threaded channel; a handle being installed in front of the water control stud; a rear side of the water control stud resisting against a front end of the cleaning inner tube; a middle section of the water control stud having a water outlet window; the window being arranged above a front end of the clean water outlet; thereby, the control handle controlling the supply of clean water directly.

* * * * *